US007895800B2

(12) United States Patent
Overgaard

(10) Patent No.: US 7,895,800 B2
(45) Date of Patent: Mar. 1, 2011

(54) FACADE PANEL AND BUILDING FACADE

(75) Inventor: Torben Overgaard, Northampton (GB)

(73) Assignee: Hunter Douglas Industries Switzerland GmbH, Lucerne (CH)

( * ) Notice: Subject to any disclaimer, the term of this patent is extended or adjusted under 35 U.S.C. 154(b) by 0 days.

(21) Appl. No.: 12/764,634

(22) Filed: Apr. 21, 2010

(65) Prior Publication Data

US 2010/0263309 A1 Oct. 21, 2010

Related U.S. Application Data

(62) Division of application No. 11/079,269, filed on Mar. 15, 2005, now abandoned.

(51) Int. Cl.
*E04B 2/00* (2006.01)

(52) U.S. Cl. ..... 52/235; 52/275; 52/483.1; 52/506.08

(58) Field of Classification Search ..... 52/272, 52/275, 474, 483.1, 506.08, 384, 386, 506.05, 52/511, 235, 605, 508, 509
See application file for complete search history.

(56) References Cited

U.S. PATENT DOCUMENTS

| | | | | |
|---|---|---|---|---|
| 165,896 | A | 7/1875 | Von Versen et al. | |
| 324,716 | A | 8/1885 | Maurer | |
| 2,249,028 | A | 7/1941 | Mulderink | |
| 2,700,294 | A * | 1/1955 | Banneyer | 52/351 |
| 2,860,504 | A | 11/1958 | Sinner et al. | |
| 2,894,291 | A | 7/1959 | Sorenson et al. | |
| 3,350,830 | A * | 11/1967 | Smith, Jr. et al. | 52/509 |
| 3,353,315 | A | 11/1967 | Barker | |
| 3,452,500 | A | 7/1969 | Heirich | |
| 3,478,480 | A | 11/1969 | Swenson | |
| 3,559,358 | A | 2/1971 | Fowler | |
| 3,613,221 | A | 10/1971 | Pronk | |
| 3,786,605 | A * | 1/1974 | Winfrey | 52/235 |
| 3,888,055 | A | 6/1975 | Gallo | |
| 3,998,014 | A | 12/1976 | Bartels et al. | |
| 4,782,635 | A | 11/1988 | Hegle | |
| 4,977,730 | A | 12/1990 | Pardo | |
| 5,048,254 | A | 9/1991 | Merlau | |

(Continued)

FOREIGN PATENT DOCUMENTS

| | | |
|---|---|---|
| DE | 20212818 | 6/2002 |

(Continued)

*Primary Examiner*—Robert J Canfield
*Assistant Examiner*—Brent W Herring
(74) *Attorney, Agent, or Firm*—Greenblum & Bernstein, P.L.C.

(57) ABSTRACT

Building façade attachable to a building. The building façade includes at least two horizontally adjacent façade panels. Each respective façade panel including horizontal top and bottom edges and two vertical side edges. At least one recess is arranged on a surface of each respective façade panel directed towards the building. The at least one recess is arranged parallel to the two vertical side edges. At least one groove is arranged on the horizontal bottom edge of each respective façade panel. A mounting construction has at least one attachment element extending into the at least one groove of each respective façade panel and at least one guiding projection extending into the at least one vertical recess of each respective façade panel. The at least two horizontally adjacent façade panels are aligned approximately parallel to one another.

20 Claims, 2 Drawing Sheets

U.S. PATENT DOCUMENTS

| | | | | |
|---|---|---|---|---|
| 5,060,446 | A | 10/1991 | Beliveau | |
| 5,069,014 | A | 12/1991 | Kubbutat | |
| 5,265,389 | A | 11/1993 | Mazzone et al. | |
| 5,265,396 | A | 11/1993 | Amimoto | |
| 5,283,992 | A * | 2/1994 | Morassutti | 52/509 |
| 5,379,561 | A * | 1/1995 | Saito | 52/235 |
| 5,417,050 | A | 5/1995 | Cosentino | |
| D373,836 | S | 9/1996 | Bado et al. | |
| 5,555,690 | A * | 9/1996 | Cosentino | 52/506.08 |
| 5,619,834 | A | 4/1997 | Chen | |
| 5,941,040 | A | 8/1999 | McAnallen et al. | |
| 6,098,364 | A | 8/2000 | Liu | |
| 6,164,029 | A | 12/2000 | Lee | |
| 6,170,214 | B1 * | 1/2001 | Treister et al. | 52/511 |
| 6,205,731 | B1 | 3/2001 | Gerhaher | |
| D444,577 | S | 7/2001 | Neuhofer | |
| 6,289,644 | B1 * | 9/2001 | Gerhaher | 52/235 |
| 6,374,561 | B1 | 4/2002 | Ishiko | |
| 6,401,419 | B1 | 6/2002 | Beliveau | |
| 6,705,797 | B1 | 3/2004 | Wada | |
| 6,748,709 | B1 | 6/2004 | Sherman et al. | |
| 6,792,727 | B2 | 9/2004 | Krieger | |
| 6,964,137 | B2 | 11/2005 | Frascari | |
| 6,966,161 | B2 | 11/2005 | Palsson et al. | |
| 6,973,756 | B2 * | 12/2005 | Hatzinikolas | 52/235 |
| 7,681,370 | B2 * | 3/2010 | Waters et al. | 52/506.08 |
| 2002/0124498 | A1 | 9/2002 | Knappe | |
| 2003/0079431 | A1 | 5/2003 | Schuman et al. | |
| 2003/0126817 | A1 | 7/2003 | Gleeson et al. | |
| 2003/0150179 | A1 | 8/2003 | Moreno | |
| 2004/0025459 | A1 | 2/2004 | Heubner et al. | |
| 2004/0255480 | A1 | 12/2004 | Gleeson | |
| 2007/0151190 | A1 | 7/2007 | Huff et al. | |
| 2008/0005985 | A1 | 1/2008 | Lin | |
| 2008/0010922 | A1 | 1/2008 | Wagner | |

FOREIGN PATENT DOCUMENTS

| | | |
|---|---|---|
| GB | 2015635 | 9/1979 |
| JP | 6-146448 | 5/1994 |

* cited by examiner

FACADE PANEL AND BUILDING FACADE

CROSS-REFERENCE TO RELATED APPLICATIONS

The present application is a divisional application of U.S. patent application Ser. No. 11/079,269 filed Mar. 15, 2005, which claims priority under 35 U.S.C. §119 of German Patent Application No. 10 2004 013 016.7, filed on Mar. 16, 2004, the disclosures of which are expressly incorporated by reference herein in their entireties.

BACKGROUND OF THE INVENTION

1. Field of the Invention

The invention relates to a facade panel with a front and a rear that can be aligned to a building, and with edges running vertically and horizontally, limiting the façade panel. Further, the invention relates to a building facade with façade panels and with a mounting construction for attaching the façade panels to the building.

2. Discussion of Background Information

Building facades and the corresponding façade panels are known from practice. The majority of façade panels are embodied in a rectangular manner, thus provided with edges running exclusively horizontally and vertically. The joint-aligned alignment of the façade panel, i.e., with aligned joints and always the same joint width, can often be ensured only with great mechanical effort, since the associated mounting construction by means of which the façade panels are held onto the building usually allows a certain mobility and free positioning capability of the respective façade panel in its provided installation site for equalizing tolerances. Joint profiles are therefore often used, i.e., extruded profiles of metal or plastic which are inserted in the joints. A joint running smoothly between the façade panels is ensured by placing the adjacent façade panels against this joint profile. However, the architects' freedom of design in the embodiment of the building façade is adversely affected by this.

SUMMARY OF THE INVENTION

The present invention provides a façade panel and a building façade that can render an exact joint course between the individual façade panels, resulting in the greatest possible freedom of design of the façade.

According to an embodiment of the invention, the façade panel can include recesses arranged on a line running vertically, whereby the line runs parallel to a vertical edge of the façade panel on the rear. According to another embodiment, the building façade may include two horizontally adjacent façade panels parallel to their two vertical adjacent edges featuring recesses on the rear sides directed toward the building. The recesses are respectively arranged on a line that runs parallel to a vertical edge of the respective façade panel, and projections are provided on the mounting construction, which projections extend into the recesses such that the façade panels are aligned exactly parallel to one another.

The invention proposes creating an "invisible" guide system, i.e., provided on the rear of the façade panel, which renders possible the correct vertical alignment of several façade panels one above the other or of two laterally adjacent façade panels next to one another, thus ensuring the desired vertical joint courses. Since the above mentioned guide system is provided on the rear of the façade panels, no profiles projecting into the joints are necessary which would restrict the design of the joints and thus the freedom of design of the building façade.

According to the invention, an embodiment can include for the vertical alignment of the façade panel at least two recesses which are provided at a distance one above the other on the rear of the façade panel. The at least two recesses lie on a line that runs parallel to the lateral vertical edge of the façade panel. Further, a vertical alignment of the façade panel or its lateral edge can be rendered possible through corresponding projections which are provided on the mounting construction and which extend into these recesses. A vertical alignment of the opposite lateral edge can also be automatically ensured through the above arrangement, so that in all, a very regular and homogenous joint image can be achieved without auxiliary structure visible from the outside. Since the mounting construction, e.g., a metallic support construction, can be produced with great precision, the attachment of the projections to the mounting construction can also be made with great precision. In particular, the arrangement of the projections makes it possible for the correct and exact positioning of the individual façade panels. Also, the actual attachment method of the façade panels to the mounting construction provides a certain mobility of the attachment elements for equalizing tolerances, which makes it possible to align the attachment elements according to the specific conditions of the façade panels.

In order to be able to compensate for irregularities that can occur during the production process of the façade panels, the recesses in the façade panel can be made at the end of the production process. For example, if the façade panels are made of clay or a similar material, it possible during the firing or hardening process, the geometry of the façade panels could be influenced which could cause irregularities. Further, if the recesses are not made in the rear of the façade panel until after the firing process, it can be ensured that these recesses are arranged with the desired precision. Furthermore, with the precisely arranged recesses and the accurately aligned projections in the area of the mounting construction, together provide the desired positionally accurate arrangement of the façade panel on the building.

In particular, if the façade panel is embodied as a corner panel, e.g., a mitered vertical corner edge, the positioning and alignment of the façade panel via the recesses on the façade panel and the projections on the mounting construction provides a solution to existing problems over the current industry practices, such as the use of undesirable joint profiles. Thus, the present invention is particularly advantageous with such corner panels.

The recesses can be embodied as individual bores, slotted holes or the like. However, in terms of production technology, it may be economically advantageous for the recesses to be combined into a through groove. Which, could allow for the use of the corresponding profiles attached to the mounting construction and which feature a flank that extends into the recess of the façade panel or several façade panels. For example, simple, commercial and economical L-shaped angle profiles can be used which are attached by their one flank to the mounting construction and extend with the other flank into the groove-shaped recess of the façade panel. Although a desired precise lateral guidance of the façade panel is given through the continuous geometry of the groove, which is not linked to specific points of the L-shaped angle profile. Great scope is given in the attachment, in terms of height of the angle profile (or the alignment in terms of height of the façade panel), so that an uncomplicated and rapid mounting can be supported.

In order to be able to easily absorb thermal expansions or shocks from seismic causes, it is possible a single line provided with recesses can be provided on the rear of the façade panel. This allows the façade panel to be able to work freely on both sides of this line under the given influences and, e.g., can expand, vibrate or the like. If the line with the recesses runs near a vertical edge, this edge is described as "provided with recesses." As with a component fixed on one side, this edge of the façade panel can be regarded as a "fixed bearing". Whereas the opposite edge can be seen as a "loose bearing" which, although it is attached to the mounting construction, can work and conform to the seismic or thermal conditions due to the above-mentioned tolerances and mobilities with this type of attachment so that the façade panel can, e.g., expand or contract.

BRIEF DESCRIPTION OF THE DRAWINGS

The present invention is further described in the detailed description which follows, in reference to the noted plurality of drawings, in which like reference numerals represent similar parts throughout the several views of the drawings, and wherein.

DETAILED DESCRIPTION OF THE PRESENT INVENTION

Figure 1:
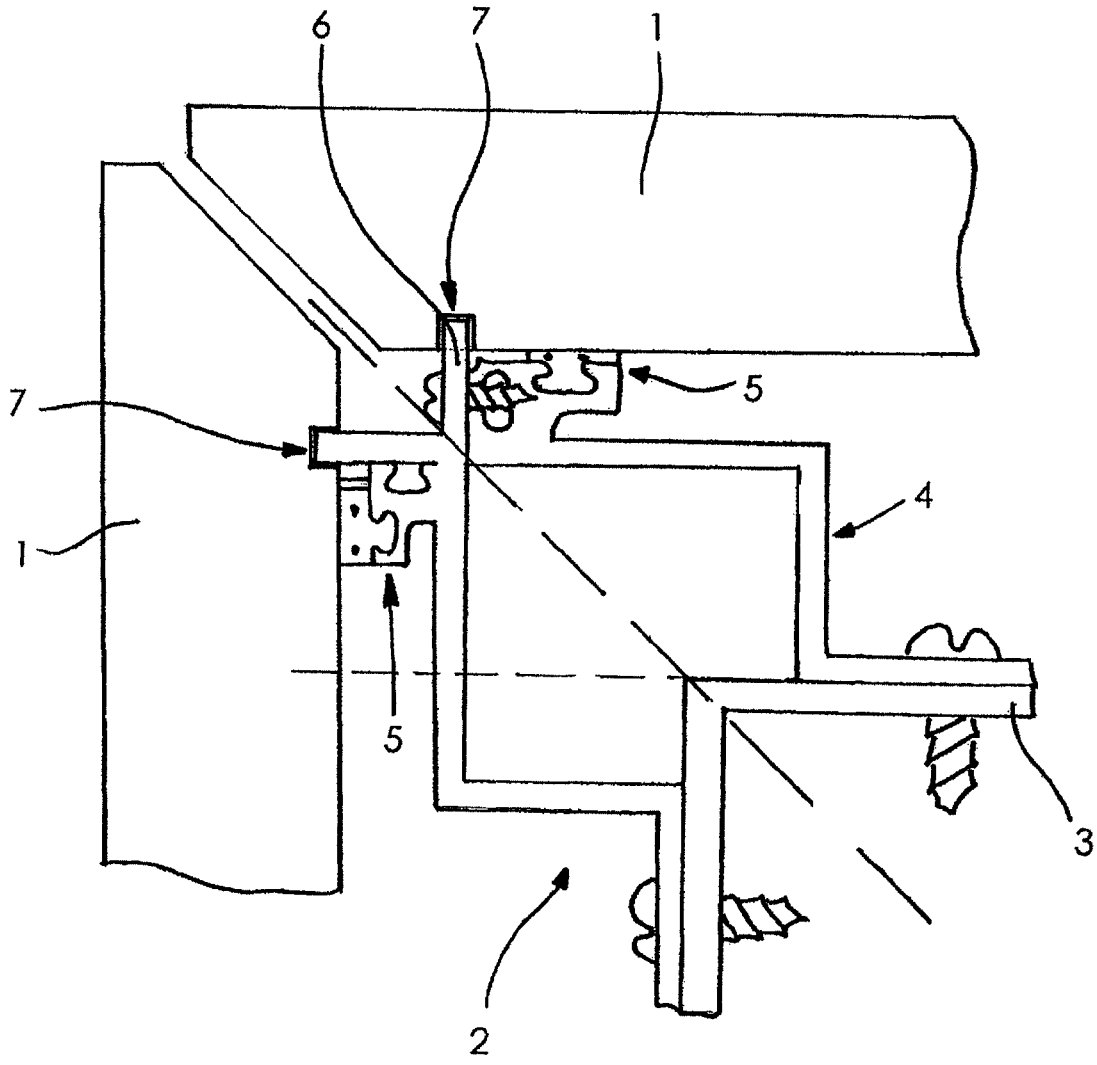
FIG. 1 shows an exemplary embodiment of a horizontal cross section through a corner embodiment of a building façade.

FIG. 1 shows a façade panel which can be attached to a mounting construction labeled as a whole with 2, whereby the mounting construction 2, in turn is attached to a building (not shown).

According to an embodiment of the invention, FIG. 1 shows the mounting construction 2 having an angle bracket 3 attached to the building. A hollow profile 4 with a roughly square cross section extends from the angle bracket 3, whereby this hollow profile 4 can be formed by a single or two separate, approximately Z-shaped profiles. The hollow profile 4 can be embodied as a continuous extruded profile or as a plurality of supports arranged spaced one above the other which respectively feature only a limited height of, e.g., 5 cm or 10 cm. A spacer profile arrangement is labeled as a whole with 5. A spacer profile with damping material properties, e.g., of EPDM, can be used for the vibration-damping mounting of the façade panel 1 to the remaining mounting construction 2.

Figure 2:
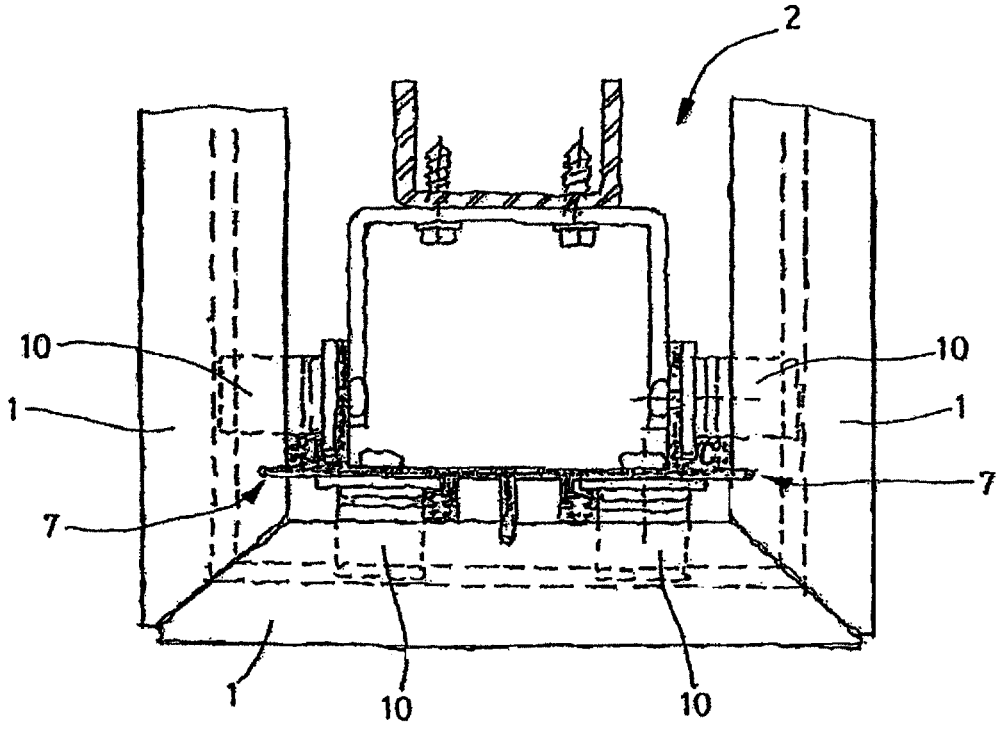
FIG. 2 shows an exemplary embodiment of a horizontal cross section through a column or support cladding.
Figure 3:
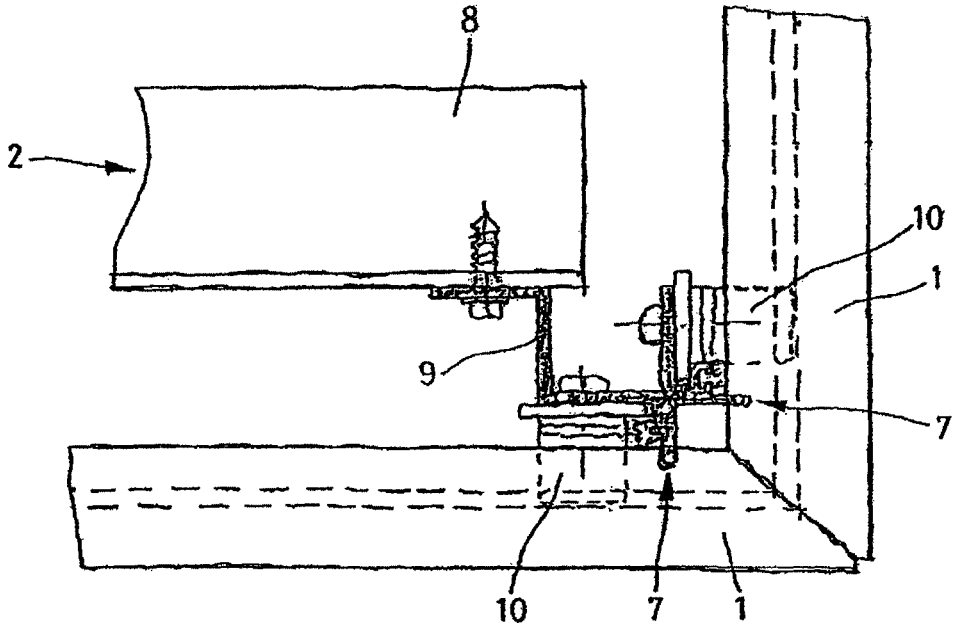
FIG. 3 shows an alternate exemplary embodiment of a corner embodiment of a façade construction.

FIGS. 2 and 3 show the attachment elements 10 that can be provided on the hollow profile, so as to hold the façade panels 1. Further, the attachment elements 10 can be embodied, e.g., as J-shaped or U-shaped holders, which wrap around the façade edges, in that they extend, e.g., under the façade panel 1 and engage in a groove running on the panel lower edge.

In addition, an L-shaped angular profile 6 can be provided on the mounting construction 2 which may be attachable to the mounting construction 2 and extend with both ends of its two flanks into one groove 7 of the one façade panel 1. Further, so that these two adjacent façade panels 1 embodied between them, provide for a defined joint of equal width over the entire height of the façade panel 1.

According to an embodiment of the invention, it possible to ensure the alignment of the joints of the façade panels 1 by the above noted construction, even if the angular profile 6 extends over the height of the façade panel as shown next to the higher façade panel or if the angular profile 6 is arranged under the height of the façade panel as shown next to the lower façade panel.

Still referring to FIG. 2, the façade panels can be embodied both as one vertical edge as a corner panel so only one vertical edge is mitered as a corner edge, but also can be provided so as to form corner edges on both opposite vertical edges. For example, in the case of small-sized façades, e.g., the cladding of a support construction, one or more of the façade panels can be used to form corner edges on both opposite vertical edges.

Further, the center façade panel 1 shows the groove which does not run closely adjacent to a certain corner edge, but the groove 7 runs at the center of the façade panel 1. (See FIG. 1). Further, this arrangement provides in the case of changes in the geometry of the façade panel 1, e.g., due to thermal influences, an identical change of the joint width will occur on both joints of the façade panel 1 and thus an identical joint image is achieved. In contrast, the two façade panels 1 shown at the side in FIG. 1 are provided with a groove 7 near a single edge.

FIG. 3 shows an exemplary embodiment of a corner arrangement of the building façade with a mounting construction 2 embodied differently compared to FIG. 1. For example, the above noted corner arrangement shows a mounting angle 8 starting from an arm 9 with multiple offsets which extends to support the two façade panels 1.

What is claimed:

1. A building façade attachable to a building, the building façade comprising:

at least two horizontally adjacent façade panels;

each respective façade panel including horizontal top and bottom edges and two vertical side edges;

at least one recess arranged on a surface of each respective façade panel directed towards the building, the at least one recess being arranged parallel to the two vertical side edges;

at least one groove on the horizontal bottom edge of each respective façade panel; and a mounting construction having at least one attachment element extending into the at least one groove of each respective façade panel and at least one guiding projection extending into the at least one vertical recess of each respective façade panel, whereby the at least two horizontally adjacent façade panels are aligned parallel to one another.

2. The building façade of claim 1, wherein the at least one recess is a groove.

3. The building façade of claim 2, wherein the groove runs vertically from the horizontal top and bottom edges.

4. The building façade of claim 3, wherein the groove is arranged adjacent one of the two vertical side edges of a respective façade panel.

5. The building façade of claim 1, wherein the at least one recess is arranged adjacent one of the two vertical side edges of a respective façade panel.

6. The building façade of claim 1, wherein the at least one guiding projection extends loosely into a respective at least one recess.

7. The building façade of claim 1, wherein one of:

one of the adjacent façade panels is structured as a corner panel; and the adjacent façade panels form a corner.

8. The building façade of claim 1, wherein one of the adjacent façade panels comprises a mitered vertical side edge.

9. The building façade of claim 1, wherein the adjacent façade panels form a mitered corner.

10. The building façade of claim 1, wherein each respective façade panel is attachable to the building by the mounting construction.

11. The building façade of claim 1, wherein the mounting construction is an angle bracket.

12. The building façade of claim 1, wherein the mounting construction is a hollow profile.

13. The building façade of claim 12, wherein the hollow profile is one of:

an approximate square cross section;

a single piece z-shape profile;

a multiple piece z-shape profile;

a continuous extruded profile; and a plurality of supports spaced one above another.

14. The building façade of claim 1, wherein the mounting construction includes at least one of: at least one spacer having vibration damping properties and at least one attachment element that is one of J-shaped and U-shaped.

15. The building façade of claim 1, wherein the mounting construction is attachable to at least one L-shape angular element, wherein each L-shape angular element has at least two flank ends extending into a respective at least one recess to provide for a defined joint of equal width over an entire height between the façade panels.

16. A method of attaching the building façade of claim 1 to a building, the method comprising:

securing, to the building, the mounting construction; and attaching the façade panels to the building via the mounting construction.

17. A building façade attachable to a building, the building façade comprising:

plural horizontally adjacent façade panels;

each respective façade panel including horizontal top and bottom edges and vertical side edges;

at least one vertically oriented recess arranged on a surface of each respective façade panel directed towards the building;

at least one groove on the horizontal bottom edge of each respective façade panel;

at least one mounting device structured and arranged to mount each façade panel to the building; and each mounting device comprising at least one attachment element extending into the at least one groove of a respective façade panel and at least one guiding projection extending into the at least one vertical recess of a respective façade panel.

18. The building façade of claim 17, wherein the plural horizontally adjacent façade panels are aligned parallel to one another.

19. A method of attaching the building façade of claim 17 to a building, the method comprising:

securing, to the building, the at least one mounting device; and attaching the façade panels to the building via the at least one mounting device.

20. A building façade attachable to a building, the building façade comprising:

plural horizontally adjacent façade panels;

each respective façade panel including horizontal top and bottom edges and vertical side edges;

at least one vertically oriented recess arranged on a surface of each respective façade panel directed towards the building;

at least one groove on the horizontal bottom edge of each respective façade panel;

at least one mounting device structured and arranged to mount the plural façade panels to the building; and the at least one mounting device comprising:

a first part attachable to the building;

a second part having a portion that extends into the at least one groove of a respective façade panel;

a third part having a portion extending into the at least one vertical recess of the respective façade panel; and a fourth part connecting the first part to the second and third parts.

* * * * *

UNITED STATES PATENT AND TRADEMARK OFFICE

CERTIFICATE OF CORRECTION

PATENT NO. : 7,895,800 B2
APPLICATION NO. : 12/764634
DATED : March 1, 2011
INVENTOR(S) : T. Overgaard It is certified that error appears in the above-identified patent and that said Letters Patent is hereby corrected as shown below:

On the Title Page, Item (30) please add:

--Foreign Application Priority Data
DE 10 2004 013016 7 Mar. 16, 2004--

Signed and Sealed this
Tenth Day of January, 2012

David J. Kappos

David J. Kappos
*Director of the United States Patent and Trademark Office*